US008054997B2

(12) United States Patent
Taso

(10) Patent No.: US 8,054,997 B2
(45) Date of Patent: Nov. 8, 2011

(54) STRUCTURE OF SPEAKER

(76) Inventor: Yueh-Ming Taso, Taipei (TW)

( * ) Notice: Subject to any disclaimer, the term of this patent is extended or adjusted under 35 U.S.C. 154(b) by 436 days.

(21) Appl. No.: 12/427,450

(22) Filed: Apr. 21, 2009

(65) Prior Publication Data

US 2010/0266154 A1 Oct. 21, 2010

(51) Int. Cl.
*H04R 25/00* (2006.01)

(52) U.S. Cl. ..... 381/186; 381/423

(58) Field of Classification Search ..... None
See application file for complete search history.

(56) References Cited

U.S. PATENT DOCUMENTS 6,343,128 B1 * 1/2002 Coffin ..... 381/186
7,899,202 B2 * 3/2011 Sumitani et al. ..... 381/398
2007/0242850 A1 * 10/2007 Sumitani et al. ..... 381/413

* cited by examiner

*Primary Examiner* — Charles Garber
*Assistant Examiner* — Andre' C Stevenson
(74) *Attorney, Agent, or Firm* — WPAT, P.C.; Anthony King

(57) ABSTRACT

An improved structure of a speaker comprises a speaker frame disposed with a yoke at a lower end, the yoke is disposed with a magnet that is sleeved with a voice coil pipe; a lower damper is sleeved onto the voice coil pipe through a hole, with an outer edge of the damper attached to the outer edge of the bottom inside the speaker frame; a washer is overlapped at the outer edge of the lower damper, then an upper damper is sleeved onto the voice coil pipe through a hole, with its outer edge attached to the washer; two cones are hooked up and attached to each other with a hole of the two cones sleeved onto the voice coil pipe, and an outer edge of a cone surround is attached to a rim of the speaker frame to form the improved structure of the speaker.

6 Claims, 3 Drawing Sheets

STRUCTURE OF SPEAKER

BACKGROUND OF THE INVENTION

1. Field of the Invention

The present invention relates to an improved structure of a speaker, more particularly, to an improved structure of a speaker in which a join of a voice coil pipe is strengthened to effectively increase strength and reduce distortion.

2. Description of the Prior Art

Please refer to FIG. 1 for a sectional view of a traditional speaker, which mainly comprises:

a speaker frame 1, the speaker frame 1 is connected with a yoke 11 at its lower end, a magnet 12 is disposed in the yoke 11, and a rim 13 extends from an outer edge of the speaker frame 1;

a voice coil pipe 2, the voice coil pipe 2 comprises a paper pipe 21 and a coil 22, the coil 22 is wound at the lower end of the paper pipe 21, the voice coil pipe 2 is sleeved onto the outside of the magnet 12 of the speaker frame 1;

a damper 3, the damper 3 comprises a hole 31 opened at a center thereof, the damper 3 is sleeved onto to the voice coil pipe 2 through the hole 31, the outer edge of the damper 3 is attached to the outer edge of the bottom inside the speaker frame 1, and the hole 31 of the damper 3 is attached to the voice coil pipe 2 through the colloid;

a cone 4, the cone 4 comprises a surround 41 formed on the outer edge thereof, and a hole 42 opened at a center of the cone 4, the cone 4 is sleeved onto the voice coil pipe 2 through the hole 42, the outer edge of the surround 41 is attached to the rim 13 of the speaker frame 1 through the colloid, and the hole 42 of the cone 4 is attached to the voice coil pipe 2 through the colloid;

a diaphragm 5, the diaphragm 5 wraps up the upper end of the voice coil pipe 2; and a traditional speaker is formed by assembling the above components, however, since the traditional voice coil pipe 2 is held by the damper 3 and the cone 4 at two points on the voice coil pipe 2, the strength of the join of the voice coil pipe 2 is weak; when the voice coil pipe 2 is vibrating upward and downward in high speed, it is easy to cause the voice coil pipe 2 to shift horizontally and to cause the cone 4 to deform in the long term.

Therefore, the traditional speaker still presents some shortcomings to be overcome.

In view of the above, the inventor of the present invention has put a lot of efforts in studying the deficiencies in the traditional speaker; after years of constant research, the inventor has proposed an improved structure of a speaker in the present invention.

SUMMARY OF THE INVENTION

It is an object of the present invention to provide an improved structure of a speaker which greatly strengthens the join of the voice coil pipe to effectively increase strength and reduce distortion.

It is another object of the present invention to provide the improved structure of a speaker which strengthens the connection rigidity of the voice coil pipe, so the voice coil pipe will not shift horizontally and the cone will not deform when the voice coil pipe is vibrating upward and downward in high speed.

To achieve the above objects, an improved structure of a speaker mainly comprises: a speaker frame, a yoke, a magnet, a voice coil pipe, a lower damper, a washer, an upper damper and two cones; wherein the speaker frame has a yoke disposed at a lower end thereof, a magnet disposed in the yoke, and a voice coil pipe sleeved onto the outside of the magnet. Furthermore, the lower damper is suitably sleeved to the voice coil pipe through the hole opened thereon, and an outer edge of the lower damper is attached to the outer edge of the bottom inside the speaker frame through the colloid, and a washer is disposed on the outer edge of the lower damper. Meanwhile, the upper damper is sleeved onto the voice coil pipe through the hole opened thereon, and an outer edge of the upper damper is attached to the washer through the colloid, thereby keeping the upper and lower dampers parallel to each other with an interval. Finally, the two cones are hooked up face-to-face and glued together by the colloid to form a flying-saucer-like shape, then the two cones are sleeved onto the voice coil pipe through the holes, and the outer edge of the surround of the cone is attached to the rim of the speaker frame through the colloid; then the improved structure of a speaker is formed by assembly the above components.

These features and advantages of the present invention will be fully understood and appreciated from the following detailed description of the accompanying Drawings.

DESCRIPTION OF THE PREFERRED EMBODIMENT

Figure 1:
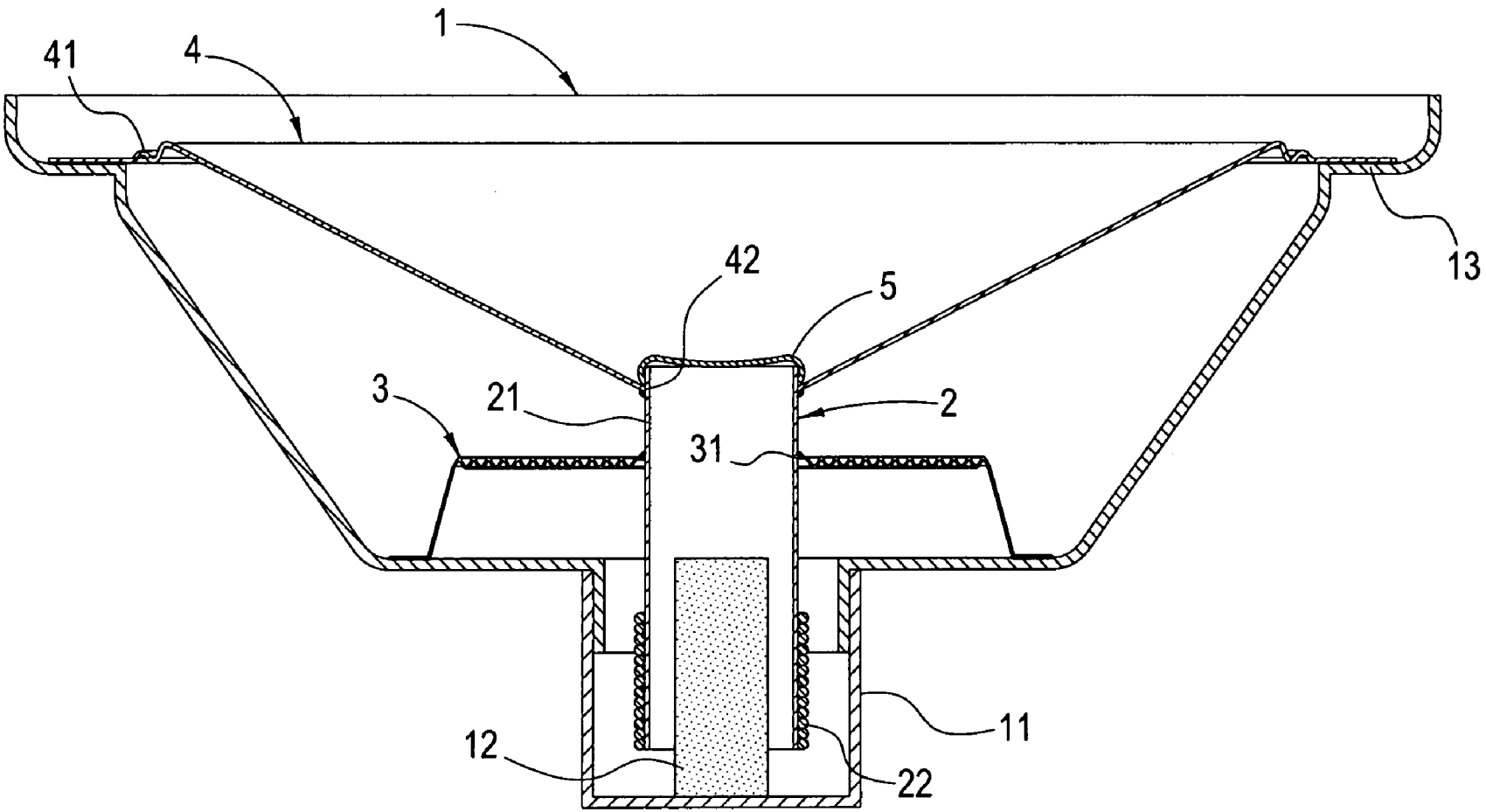
FIG. 1 illustrates a sectional view of a traditional speaker.
Figure 2:
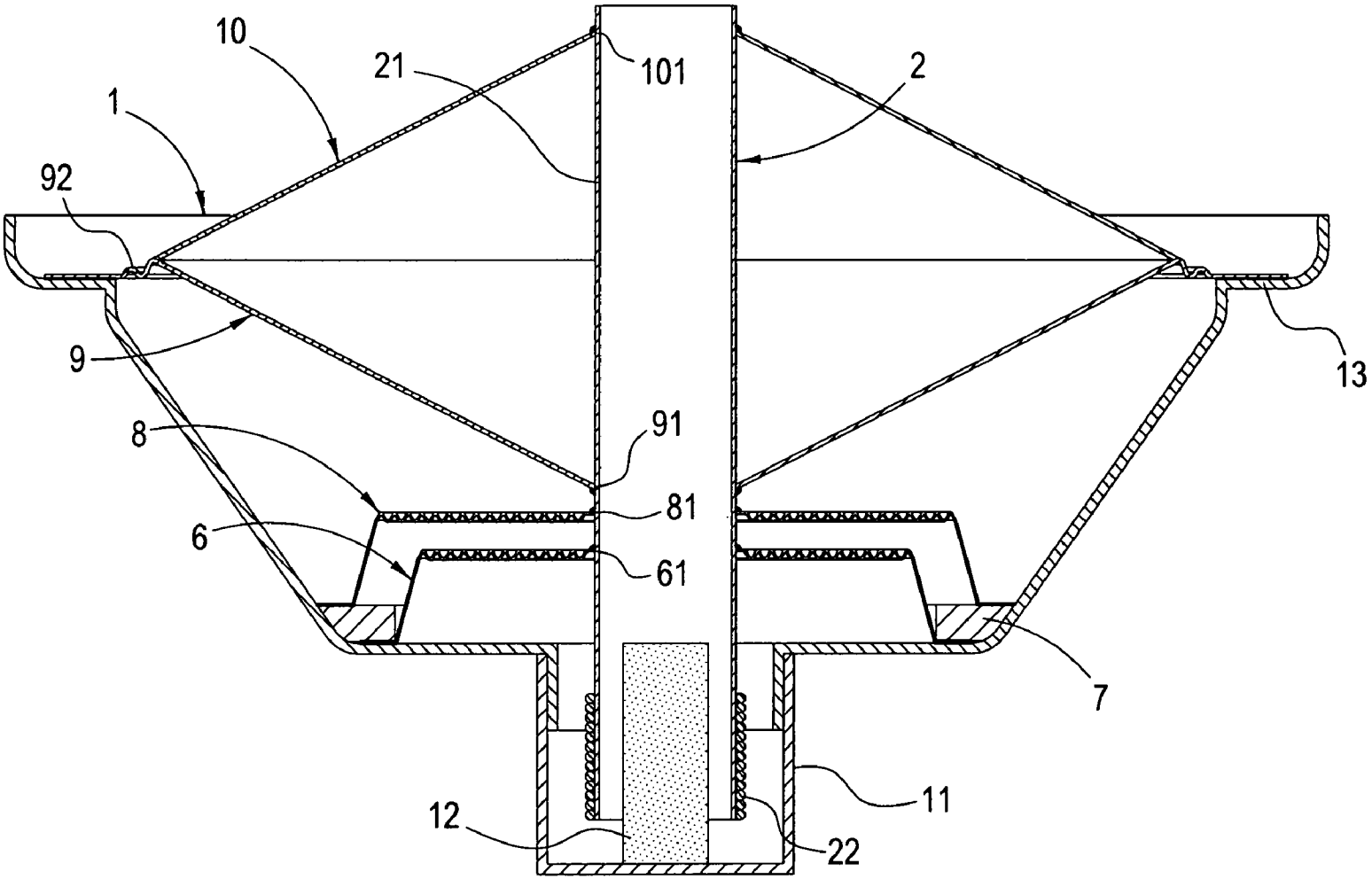
FIG. 2 illustrates a sectional view of an improved structure of a speaker.
Figure 3:
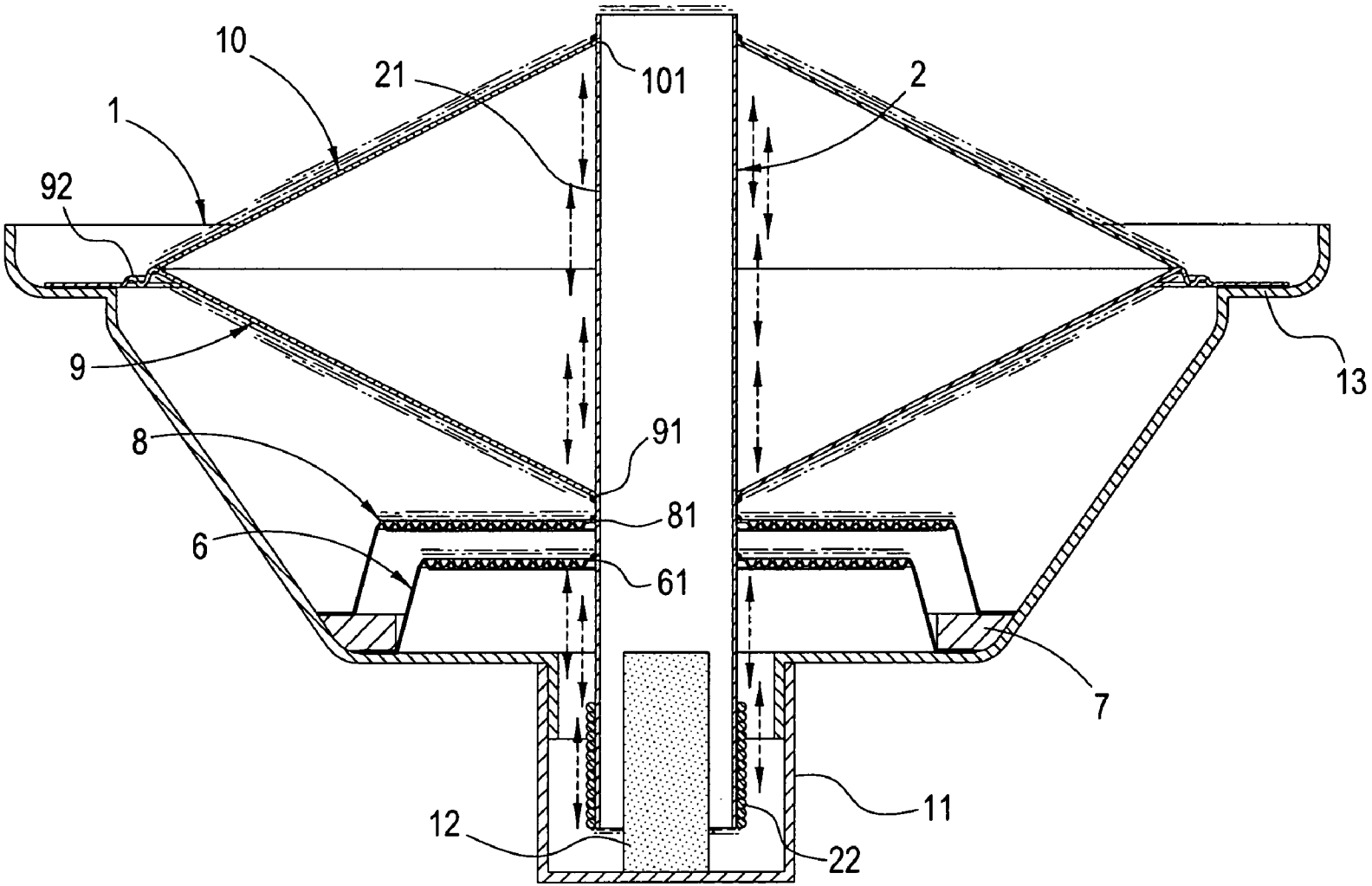
FIG. 3 illustrates a vibrating view of a voice coil pipe of the improved structure of a speaker.

Please refer to FIG. 2 and FIG. 3 for views of an improved structure of a speaker, which comprises:

a speaker frame 1, the speaker frame 1 has a yoke 11 disposed at a lower end thereof, and a magnet 12 disposed in the yoke 11, and a rim also extends from an outer edge of the speaker frame 1;

a voice coil pipe 2, the voice coil pipe 2 comprises a paper pipe 21 and a coil 22, the coil 22 is wound at a lower end of the paper pipe 21, the voice coil pipe 2 is sleeved onto the outside of the magnet 12 of the speaker frame 1;

a lower damper 6, the lower damper 6 has a hole 61 opened at a center thereon, the lower damper 6 is sleeved onto the voice coil pipe 2 through the hole 61; wherein the outer edge of the lower damper 6 is attached to the outer edge of the bottom inside of the speaker frame 1 through the colloid, the hole 61 of the lower damper 6 is attached to the voice coil pipe 2 through the colloid;

a washer 7, the washer 7 is attached to the outer edge of the lower damper 6 by the colloid;

an upper damper 8, the upper damper 8 has a hole 81 opened at a center thereon, the upper damper 8 is sleeved onto the voice coil pipe 2 through the hole 81; wherein the outer edge of the upper damper 8 is attached to the washer 7 through the colloid, and the hole 81 of the upper damper 8 is attached to the voice coil pipe 2 through the colloid;

a lower cone 9, the lower cone 9 has a hole 91 opened at a center thereon, the lower cone 9 also has a surround 92 suitably formed at an outer edge thereof, the lower cone 9 is sleeved onto the voice coil pipe 2 through the hole 91; wherein the outer edge of the lower cone 9 is attached to the rim 13 of the speaker frame 1 through the colloid, and the hole 91 of the lower cone is attached to the voice coil pipe 2 through the colloid; and an upper cone 10, the upper cone has a hole 101 opened at a center thereon, the upper 10 is hooked up face-to-face with the lower cone 9 and sleeved onto the voice coil pipe 2 through the hole 101; wherein an opening of the upper cone 10 is attached to an opening of the lower cone 9 through the colloid to form a flying-saucer-like shape, and the hole 101 of the upper cone 10 is attached to the voice coil pipe 2 through the colloid.

Therefore, the improved structure of a speaker in the present invention is formed by assembly the above components; as shown in FIG. 3, when the voice coil pipe 2 begins to vibrate upward and downward in high speed, the holes 61, 81, 91, 101 of the upper and lower dampers 6, 8 and the upper and lower cones 9, 10 are all attached to the voice coil pipe 2 so as to move the upper and lower dampers 6, 8 and the upper and lower cones 9, 10 accordingly, thereby strengthening the whole structure by gluing the above components to the voice coil pipe 2 in multiple joins. As used throughout this specification, a join is a conjunction between voice coil pipe 2 and a rim (of the damper and/or cone) that defines a hole, such as any one of holes 61, 81, 91, and 101. Meanwhile, the voice coil pipe 2 will not shift horizontally when it is vibrating in high speed; besides, since the voice coil pipe 2 is only moving upward and downward, it is able to reduce sound distortion and to prevent the upper and lower cones 9, 10 from deforming.

The washer 7 is disposed between the upper and lower dampers 6, 8 to keep the upper and lower dampers 6, 8 parallel to each other with an interval.

Hence, the way that the upper and lower cones 9, 10 hook up and attach with each other can increase connection strength and reduce distortion.

The present invention provides an improved structure of a speaker, while compared with prior art techniques, is advantageous in:

1. The present invention provides the improved structure of a speaker which greatly strengthens the join of the voice coil pipe to effectively increase strength and reduce distortion.

2. The present invention strengthens the connection rigidity of the voice coil pipe, so the voice coil pipe will not shift horizontally and the cone will not deform when the voice coil pipe is vibrating upward and downward in high speed.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An improved structure of a speaker comprising: a speaker frame, the speaker frame having a yoke disposed at a lower end thereof, and a magnet disposed in the yoke, and a rim extending from an outer edge of the speaker frame; a voice coil pipe, the voice coil pipe having a coil wound at a lower end thereof, the voice coil pipe being sleeved onto the outside of the magnet of the speaker frame; a lower damper, the lower damper having a first hole opened thereon, the lower damper being sleeved onto the voice coil pipe through the first hole; a washer, the washer being attached to the outer edge of the lower damper by the colloid; an upper damper, the upper damper having a second hole opened at a center thereon, the upper damper being sleeved onto the voice coil pipe through the second hole; a lower cone, the lower cone having a third hole opened at a center thereon, the lower cone also having a surround suitably formed at an outer edge thereof, the lower cone being sleeved onto the voice coil pipe through the third hole; and an upper cone, the upper cone having a fourth hole opened at a center thereon, the upper being hooked up face-to-face with the lower cone and sleeved onto the voice coil pipe through the fourth hole, wherein the lower cone and the upper cone are directly connected to the surround.

2. The improved structure of speaker as claimed in claim 1, wherein the outer edge of the lower damper is attached to the outer edge of the bottom inside the speaker frame through the colloid, the first hole of the lower damper is attached to the voice coil pipe through the colloid.

3. The improved structure of speaker as claimed in claim 1, wherein the outer edge of the upper damper is attached to the washer through the colloid, and the second hole of the upper damper is attached to the voice coil pipe through the colloid.

4. The improved structure of speaker as claimed in claim 1, wherein the outer edge of the lower cone is attached to the rim of the speaker frame through the colloid, and the third hole of the lower cone is attached to the voice coil pipe through the colloid.

5. The improved structure of speaker as claimed in claim 1, wherein an opening of the upper cone is attached to an opening of the lower cone through the colloid to form a flying-saucer-like shape, and the fourth hole of the upper cone is attached to the voice coil pipe through the colloid.

6. The improved structure of speaker as claimed in claim 1, wherein the washer is disposed between the lower and upper dampers to keep the lower and upper dampers parallel with each with an interval.

* * * * *